US007258256B2

(12) United States Patent
Mitsui et al.

(10) Patent No.: US 7,258,256 B2
(45) Date of Patent: Aug. 21, 2007

(54) SURFACE PRESSURE LOAD DEVICE OF SLIDE VALVE

(75) Inventors: Kenji Mitsui, Tokyo (JP); Mototsugu Osada, Tokyo (JP)

(73) Assignee: Shinagawa Refractories Co., Ltd., Tokyo (JP)

( * ) Notice: Subject to any disclaimer, the term of this patent is extended or adjusted under 35 U.S.C. 154(b) by 0 days.

(21) Appl. No.: 10/577,326

(22) PCT Filed: Sep. 27, 2004

(86) PCT No.: PCT/JP2004/014078

§ 371 (c)(1),
(2), (4) Date: Apr. 28, 2006

(87) PCT Pub. No.: WO2005/042191

PCT Pub. Date: May 12, 2005

(65) Prior Publication Data

US 2007/0080312 A1 Apr. 12, 2007

(30) Foreign Application Priority Data

Oct. 30, 2003 (JP) ..... 2003-370621

(51) Int. Cl.
*B22D 41/40* (2006.01)

(52) U.S. Cl. ..... 222/600; 251/203

(58) Field of Classification Search ..... 251/203, 251/120–121, 326–329; 222/599, 600
See application file for complete search history.

(56) References Cited

U.S. PATENT DOCUMENTS

| | | | | |
|---|---|---|---|---|
| 3,820,693 | A * | 6/1974 | Ericson | 222/592 |
| 4,187,965 | A * | 2/1980 | Aliprandi et al. | 222/600 |
| 4,543,981 | A * | 10/1985 | Bates et al. | 251/196 |
| 4,618,126 | A * | 10/1986 | Tinnes et al. | 222/600 |
| 4,650,101 | A * | 3/1987 | Fricker | 222/600 |
| 4,991,753 | A * | 2/1991 | Inubushi et al. | 222/598 |
| 5,007,615 | A * | 4/1991 | Kernion et al. | 222/600 |
| 5,280,878 | A * | 1/1994 | Terao et al. | 222/600 |
| 5,651,909 | A * | 7/1997 | Taira et al. | 222/600 |
| 5,698,129 | A * | 12/1997 | Keller et al. | 222/600 |
| 6,276,573 | B1 * | 8/2001 | Tofuku et al. | 222/600 |

FOREIGN PATENT DOCUMENTS

| | | |
|---|---|---|
| JP | 62-207567 | 9/1987 |
| JP | 7-80631 | 3/1995 |

* cited by examiner

*Primary Examiner*—John Bastianelli
(74) *Attorney, Agent, or Firm*—Oblon, Spivak, McClelland, Maier & Neustadt, P.C.

(57) ABSTRACT

A surface pressure releasing plate and a surface pressure releasing bar are slidable relative to each other smoothly by compressing compression springs uniformly. A surface pressure applying device for a slide valve according to the present invention compresses compression springs uniformly in applying and releasing surface pressure and makes a surface pressure releasing plate and a surface pressure releasing bar smoothly slide relative to each other by matching an arrangement center of projections on the surface pressure releasing plate with an arrangement center of the compression springs.

4 Claims, 6 Drawing Sheets

SURFACE PRESSURE LOAD DEVICE OF SLIDE VALVE

FIELD OF THE INVENTION

The present invention relates to a surface pressure applying device for a slide valve, and more particularly, to a novel improvement for making a surface pressure releasing plate and a surface pressure releasing bar smoothly slide relative to each other by compressing compression springs uniformly, and for reducing weight of parts and enhancing durability of parts.

DISCUSSION OF THE BACKGROUND ART

A surface pressure applying device for a slide gate described in JP 08-117985A and a surface pressure applying device for a slide valve described in JP 2003-200256A can be given as examples of this type of conventional surface pressure applying device for a slide valve.

A common slide valve device is placed at a bottom of a vessel for molten metal, and includes two or three plate bricks with an opening for controlling an outflow of the molten metal by sliding one of the plate bricks. While in use, the plate bricks receive pressure in proportion to the depth and density of the molten metal, but resist the pressure from the molten metal by keeping in close contact to each other utilizing the repulsive force of distorted springs. It is therefore common that the required spring force amounts to a few to ten-odd tons.

The structure disclosed in JP 08-117985A distorts the springs and thus applies pressure to the plate bricks by making a surface pressure bar and a roller engage with each other.

The structure disclosed in JP 2003-200256A relieves the surface pressure with a large-diameter roller which is attached to a surface pressure control bar and climbs over a mountain-like tapered portion formed on the top surface of a surface pressure releasing bar, thus depressing the surface pressure releasing bar and distorting the springs.

The structure of JP 08-117985A, the surface pressure bar and the roller are engaged with each other to distort the springs and apply pressure to the plate bricks, cannot avoid insufficient spring distortion which results from the friction between and deformation of the surface pressure bar and the roller. When the springs are not distorted enough, there is a possibility that the pressure applied to the plate bricks cannot withstand the pressure from the molten metal, thus inviting an accident in which the molten metal leaks.

In the structure of JP 2003-200256A, a large-diameter roller attached to a surface pressure control bar climbs over a mountain-like tapered portion formed on the top surface of a surface pressure releasing bar, thus depressing the surface pressure releasing bar, distorting the springs, and relieving the surface pressure, the tapered portion on the side on which the large-diameter roller climbs up needs to have as small an angle as possible to reduce the resistance met during the climb. The mountain-like tapered portion formed on the top surface of the surface pressure releasing bar is therefore given an asymmetric shape, making it difficult to match a spring arrangement center with the center between the peaks of two mountains. As a result, different loads are applied to two large-diameter rollers, and the one climbing over the mountain-like tapered portion that is nearer to the spring arrangement center receives an excessive load to be deformed and galled. The deformation and galling could prevent smooth movement.

The problem to be solved resides in that smooth movement of the plate bricks is hindered by the asymmetric shape of the mountain-like tapered portion of the surface pressure releasing bar which makes it difficult to match a spring arrangement center in the lateral direction with the arrangement center between the peaks of two mountains, or by insufficient distortion of the springs or the like.

The present invention is most characterized in that compression springs are distorted with an even force without allowing a shift of a surface pressure releasing bar to move engagement points with projections by making a spring arrangement center coincide completely with a projection arrangement center.

A surface pressure applying device for a slide valve according to the present invention makes a spring arrangement center coincide completely with an arrangement center around which projections formed on surface pressure releasing plates are arranged, and at the same time prevents a shift of a surface pressure releasing bar from moving engagement points with the projections. This enables the surface pressure applying device to distort the compression springs always with an even force, so that surface pressure is applied to and released from plate bricks steadily without fail.

In a case where the projections are constituted of rollers, the present invention makes the surface pressure releasing bar slide more smoothly.

The surface pressure releasing bar can slide smoothly also because an upper roller placed on a lower surface of a housing is in slidable contact with the surface pressure releasing bar.

BEST MODE FOR CARRYING OUT THE INVENTION

An object of making a spring arrangement center coincide completely with a projection arrangement center and distorting compression springs with an even force so that surface pressure is applied and released smoothly has been attained by forming a tapered wedge portion formed in a surface pressure releasing bar and projections on surface pressure releasing plates.

EMBODIMENT 1

Figure 1:
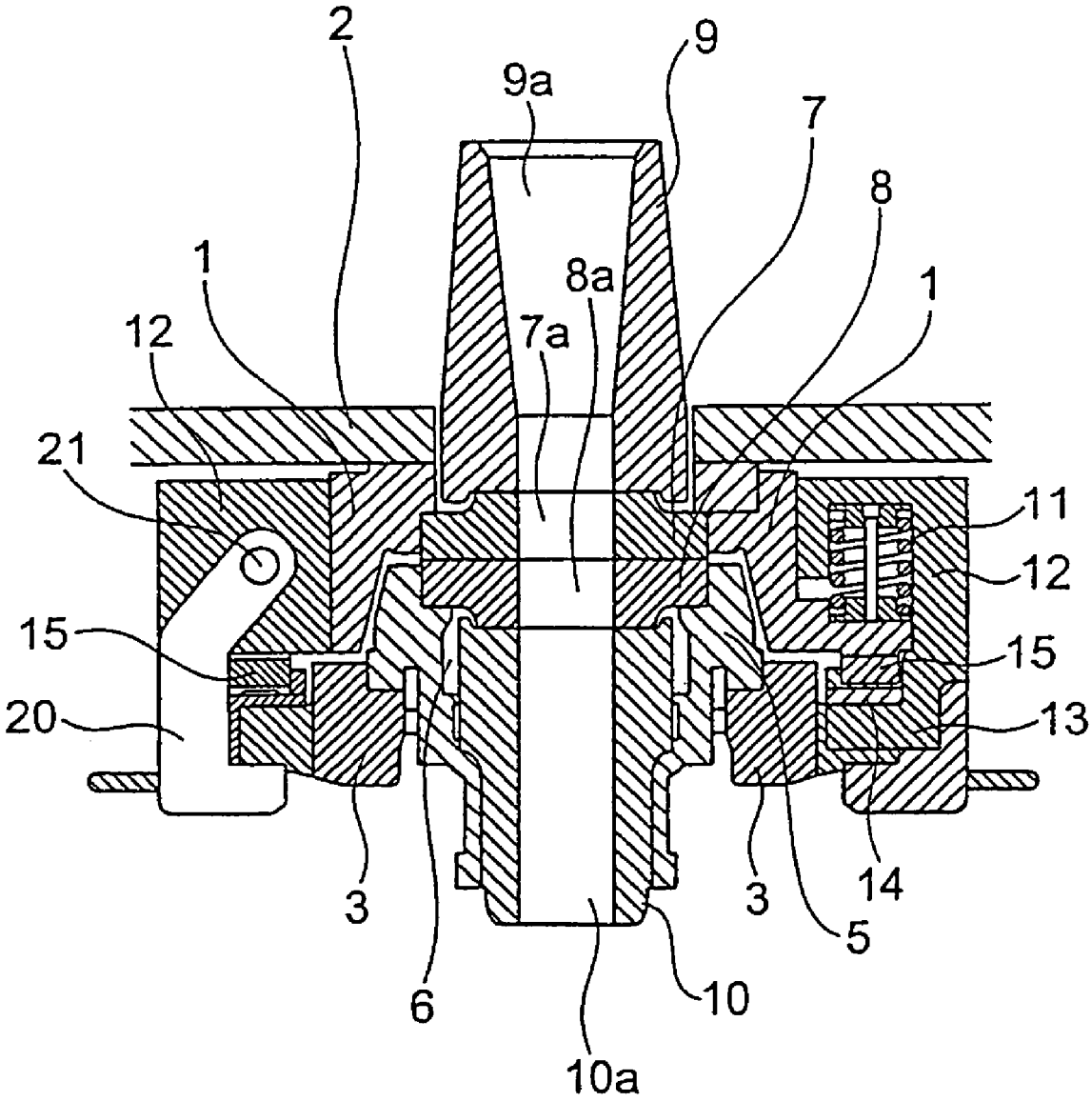
FIG. 1 illustrates a sectional view showing a surface pressure applying device for a slide valve according to the present invention.
Figure 2:
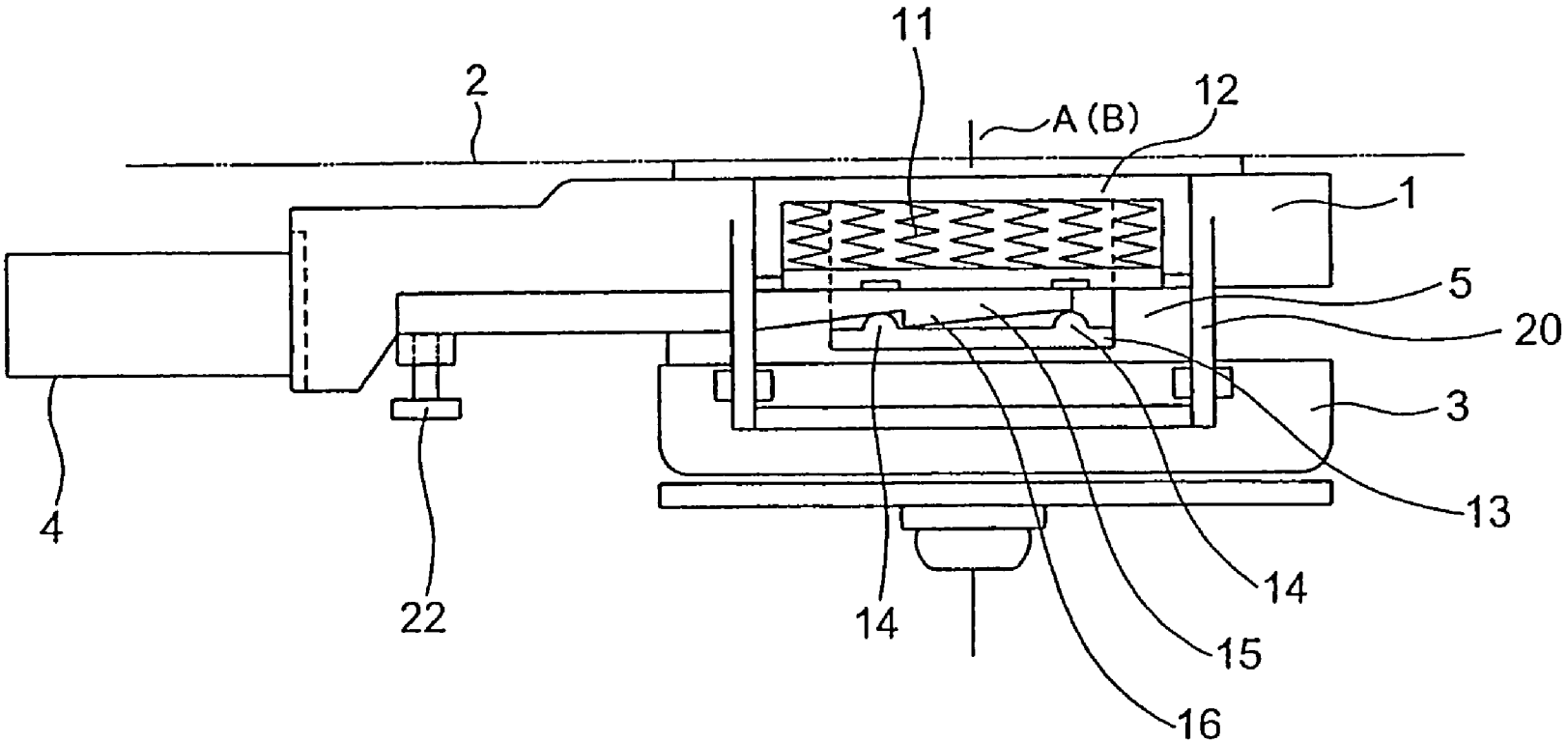
FIG. 2 shows a side sectional view of FIG. 1.

Reference numeral 1 of FIGS. 1 and 2 denotes a housing that is fixed to a bottom surface of a molten metal vessel 2 such as a ladle. Below the housing 1, clamps 3 are placed on each side of the housing 1 in a manner in which the clamps 3 can be opened and closed. Inside the clamps 3, a slide case 5 is provided which is movable in a vertical direction and connected to plate driving means 4.

The housing 1, the clamps 3, and the slide case 5 form a space 6 in which a first plate brick 7 and a second plate brick 8 are installed such that one constitutes the upper layer of two layers whereas the other constitutes the lower layer. The first plate brick 7, together with an upper nozzle 9, is fixed to the housing 1 side. The second plate brick 8 is driven to slide by the plate driving means 4.

An upper nozzle hole 9*a* opened in the upper nozzle 9 is communicated with a lower nozzle hole 10*a* of a lower nozzle 10, which is placed in a lower portion of the slide case 5, through a first nozzle hole 7*a* and a second nozzle hole 8*a*, which are opened in the first and second plate bricks 7 and 8.

A spring holder 12 for holding a plurality of compression springs 11 as surface pressure applying springs is placed on each side of the housing 1 along a longitudinal direction of the housing 1. A surface pressure releasing plate 13 is placed underneath the spring holder 12 in a manner in which the surface pressure releasing plate 13 is movable in a vertical direction integrally with the spring holder 12.

Formed on the top surface of the surface pressure releasing plate 13 are a pair of projections 14 which have at least semicircular surfaces and are distanced from each other in the longitudinal direction.

An elongated surface pressure releasing bar 15 is inserted between the housing 1 and the surface pressure releasing plate 13 in a slidable manner. A tapered wedge portion 16 is formed on a lower surface of the surface pressure releasing bar 15. The wedge portion 16 is in slidable contact with the projections 14, thereby allowing the spring holder 12 to move up and down.

An arrangement center (A) around which the peaks of the projections 14 are arranged and an arrangement center (B) around which the compression springs 11 are arranged (or, which corresponds to the position of one of the compression springs 11 that is located at the center in the longitudinal direction of the spring holder 12), coincide with each other, and the sliding motion of the surface pressure releasing bar 15 does not shift the position of the arrangement centers A and B since the engagement points with the wedge portion 16 are the projections 14. Accordingly, the compression springs 11 can be compressed with an even force as the surface pressure releasing bar 15 slides thereon.

A surface pressure applying hook 20 for clamping each clamp 3 is provided on each side of the spring holder 12 in a manner in which the surface pressure applying hook 20 can rotate about an axial supporter 21. The surface pressure applying hook 20 is engaged with the clamps 3 when surface pressure is applied to the plate bricks 7 and 8, whereas the surface pressure applying hook 20 is disengaged from the clamps 3 when the surface pressure is released.

In the structure described above, the plate driving means 4 is operated such that the second plate brick 8 alone slides while the surface pressure releasing bar 15 is disconnected from the plate driving means 4 by removing a detachable connecting pin 22. This makes the second nozzle hole 8*a* offset from the first nozzle hole 7*a*, thereby changing the relative position of the nozzle holes 7*a* and 8*a* and controlling the flow rate of molten steel.

The surface pressure releasing bar 15 is slid while being connected to the plate driving means 4 by the connecting pin 22, and the surface pressure releasing plate 13 is lifted or depressed by the surface pressure releasing bar 15, thereby making it possible to release or apply surface pressure.

Figure 3:
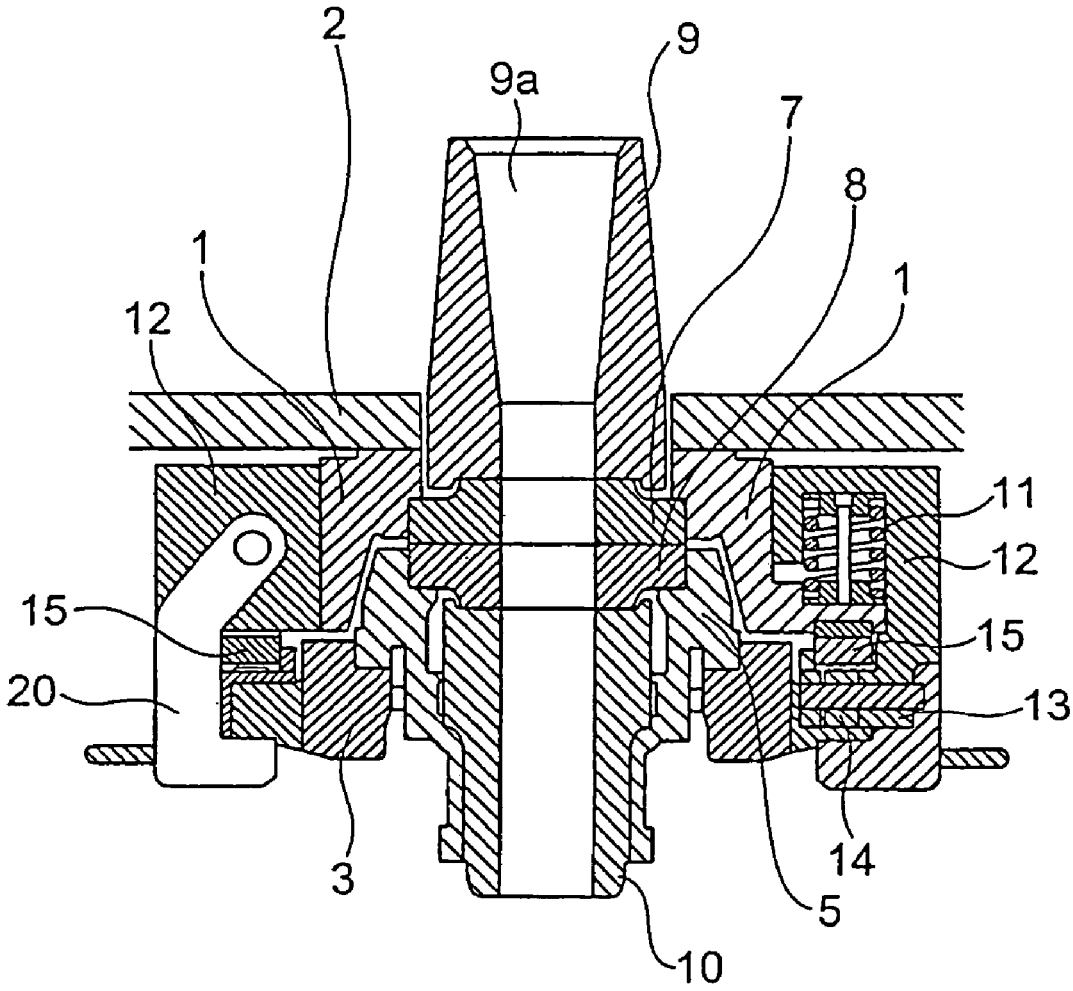
FIG. 3 shows a sectional view showing another mode of FIG. 1.
Figure 4:
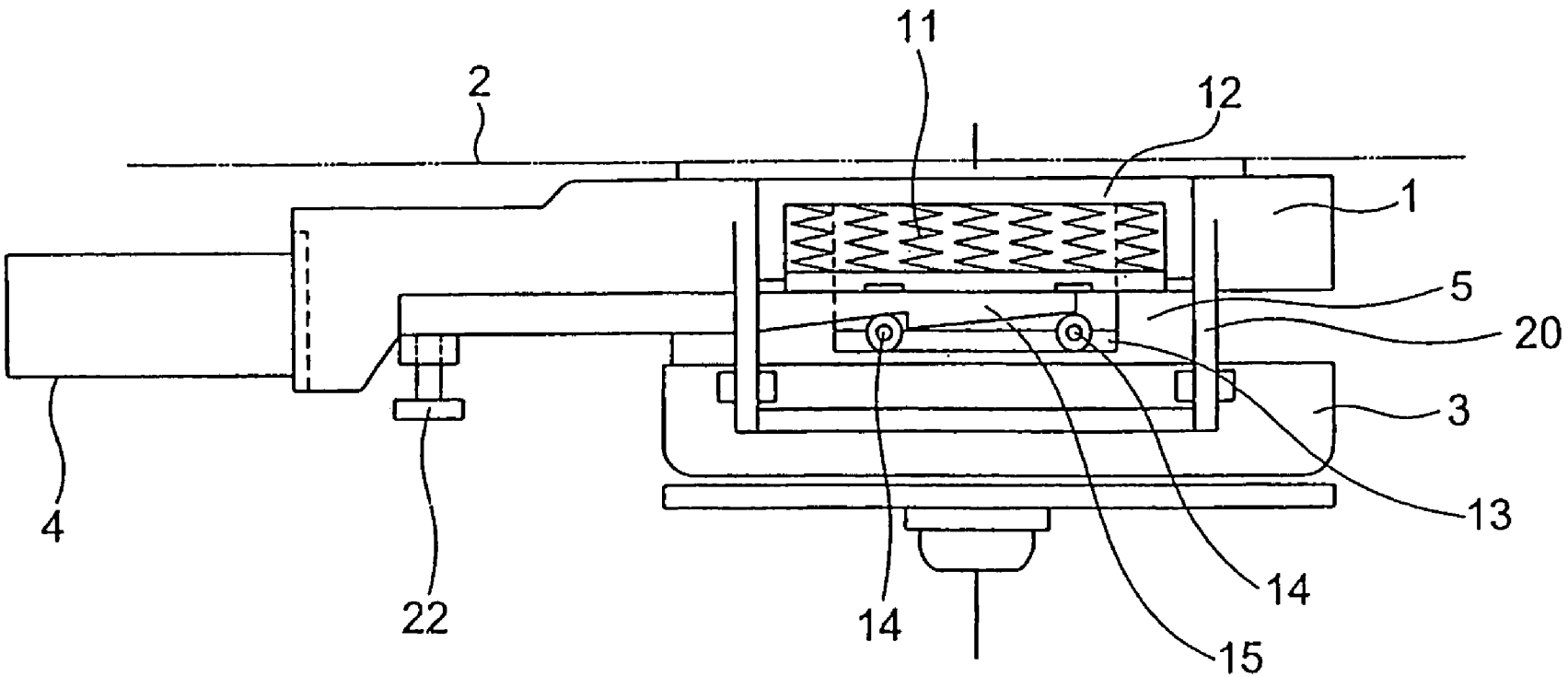
FIG. 4 shows a side sectional view of FIG. 3.

Next, FIGS. 3 and 4 show another mode (Embodiment 2) of the mode disclosed above with reference to FIGS. 1 and 2. In FIGS. 3 and 4, the projections 14 provided on the surface pressure releasing plate are constituted of rollers whose perimeter has a circular shape. The rest is the same as in FIGS. 1 and 2. Components identical to those of FIGS. 1 and 2 are denoted by the same reference symbols and the explanations thereof are omitted.

Figure 5:
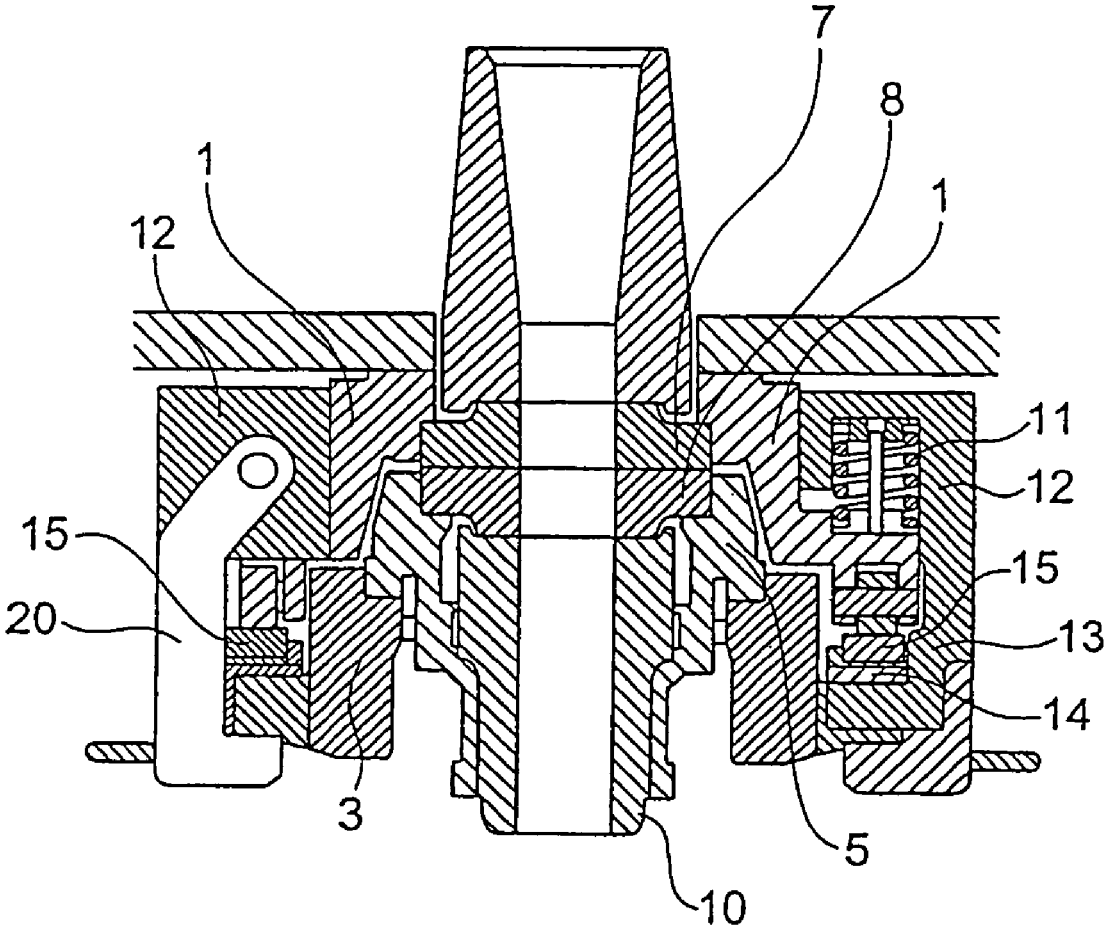
FIG. 5 shows a sectional view showing still another mode of FIG. 1.
Figure 6:
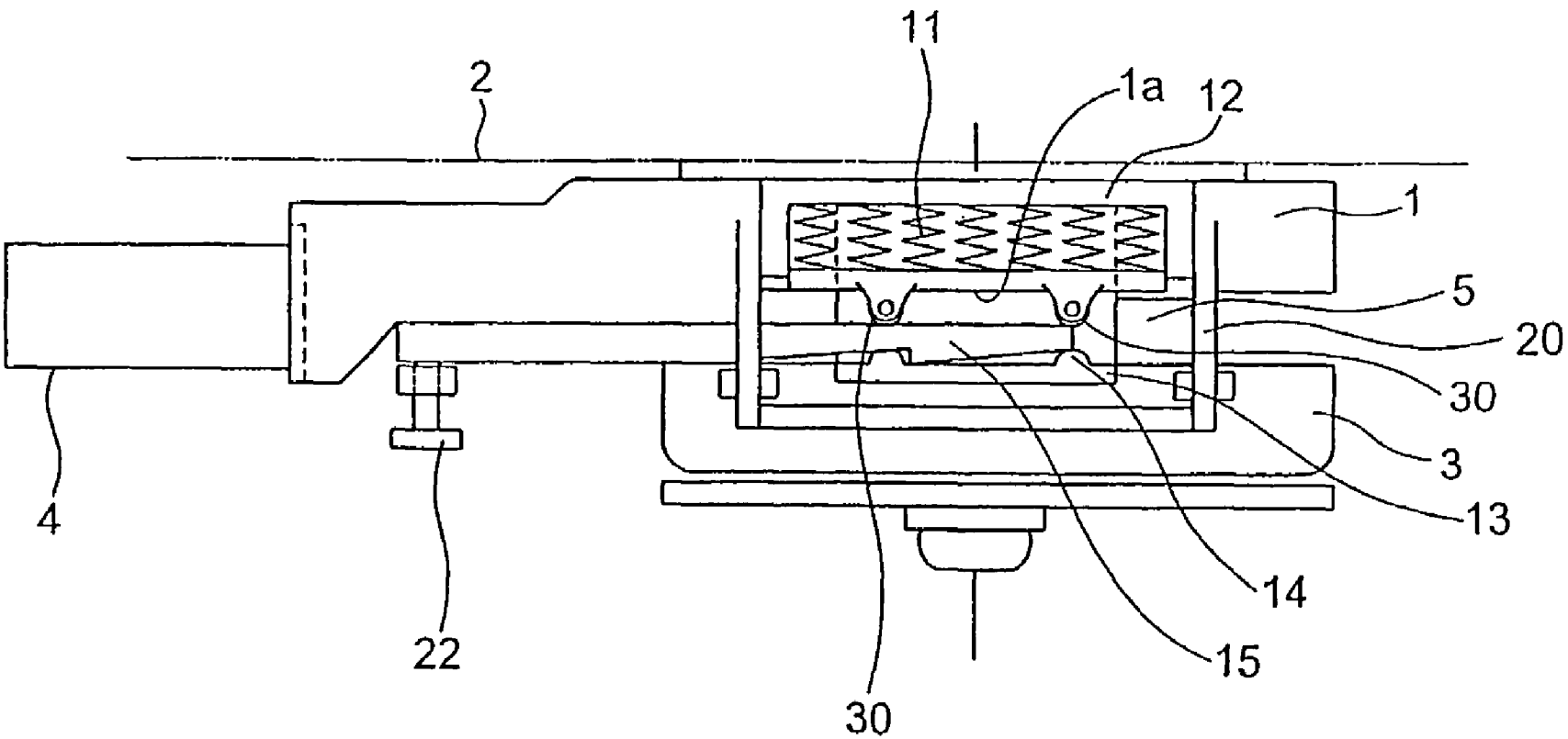
FIG. 6 shows a side sectional view of FIG. 6.

Next, FIGS. 5 and 6 show still another mode (Embodiment 3) of the mode disclosed above with reference to FIGS. 1 and 2. In FIGS. 5 and 6, a pair of upper rollers 30 are formed on a lower surface 1*a* of the housing 1 in a rotatable manner. The upper rollers 30 are positioned in opposition to the projections in a manner in which the upper rollers 30 is in slidable contact with the surface pressure releasing bar 15.

The rest is the same as in FIGS. 1 and 2. Components identical to those of FIGS. 1 and 2 are denoted by the same reference symbols and the explanations thereof are omitted.

INDUSTRIAL APPLICABILITY

By matching a spring arrangement center with a projection arrangement center, compression springs are distorted with an even force, sliding of a surface pressure releasing plate and a surface pressure releasing bar relative to each other is made smooth, and the weight of parts is reduced and the durability of parts is enhanced. The present invention is also very useful for smooth feeding of molten steel from this type of molten metal vessel.

The invention claimed is:

1. A surface pressure applying device for a slide valve that includes a housing fixed to a bottom surface of a molten metal vessel; a clamp supportedly provided to the housing in a manner that allows the clamp to open and close; and a slide case housed movably within the clamp and connected to plate driving means, the housing, the clamp, and the slide case forming a space in which at least two plate bricks are installed, the plate driving means causing one of the plate bricks to slide to change an opening of each of nozzle holes formed in the plate bricks, respectively, and control the outflow of molten metal, which comprises:

a pair of spring holders; surface pressure releasing plates with projections; and a surface pressure releasing bar with a wedge portion, the spring holders each containing plural compression springs and flanking the housing in a direction parallel with a direction in which the slide case slides, the surface pressure releasing plates being placed under the spring holders in a manner that allows the surface pressure releasing plates to move up and down integrally with the spring holders, the surface pressure releasing bar being placed between the housing and the surface pressure releasing plates, the wedge portion being tapered on a slide contact surface on which the wedge portion is in slidable contact with the projections of the surface pressure releasing plates, the projections and the compression springs being arranged such that an arrangement center of peaks of the projections coincides with an arrangement center of the compression springs, and wherein the surface pressure releasing bar is slid while connected to the plate driving means by a connecting pin, to lift or depress the surface pressure releasing plates and thereby release or apply surface pressure, the spring holders being equipped with surface pressure applying hooks for engaging with the clamp when the surface pressure is applied and disengaging from the clamp when the surface pressure is released.

2. The surface pressure applying device for a slide valve according to claim 1, wherein the projections comprise rollers.

3. The surface pressure applying device for a slide valve according to claim 1, further comprising upper rollers provided on a lower surface of the housing in opposition to the projections in a manner in which the upper rollers is in slidable contact with the surface pressure releasing bar.

4. The surface pressure applying device for a slide valve according to claim 1, wherein the plate driving means is connected to the surface pressure releasing bar through the connecting pin which is detachable.

* * * * *